US011568799B2

(12) United States Patent
Hung et al.

(10) Patent No.: US 11,568,799 B2
(45) Date of Patent: Jan. 31, 2023

(54) DRIVING CIRCUIT AND RELATED DRIVING METHOD

(71) Applicant: AU Optronics Corporation, Hsin-Chu (TW)

(72) Inventors: Chih-Hao Hung, Hsin-Chu (TW); Hung-Chi Wang, Hsin-Chu (TW); Ya-Fang Chen, Hsin-Chu (TW); Chih-Hsiang Yang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/514,248

(22) Filed: Oct. 29, 2021

(65) Prior Publication Data

US 2022/0262300 A1 Aug. 18, 2022

(30) Foreign Application Priority Data

Feb. 18, 2021 (TW) ..... 110105534

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 3/2096* (2013.01); *G09G 2300/06* (2013.01); *G09G 2310/08* (2013.01); *G09G 2320/04* (2013.01); *G09G 2320/0666* (2013.01)

(58) Field of Classification Search
CPC ..... G09G 3/32; G09G 3/2007; G09G 3/2096; G09G 2300/06; G09G 2310/08; G09G 2320/04; G09G 2320/0666; G09G 2370/08; G09G 3/2014; G09G 3/3216; G09G 3/30
See application file for complete search history.

(56) References Cited

U.S. PATENT DOCUMENTS

| | | | | |
|---|---|---|---|---|
| 7,259,742 | B2 | 8/2007 | Chang et al. | |
| 2002/0011998 | A1* | 1/2002 | Tamura | G09G 3/3611 345/204 |
| 2002/0093477 | A1* | 7/2002 | Wood | G09G 3/2081 345/89 |
| 2005/0168429 | A1 | 8/2005 | Chou | |
| 2005/0190127 | A1* | 9/2005 | Tomohara | G09G 3/3216 345/76 |
| 2008/0042936 | A1* | 2/2008 | Wang | G09G 3/32 345/76 |
| 2009/0189882 | A1 | 7/2009 | Huang et al. | |

* cited by examiner

*Primary Examiner* — Andrew Sasinowski
(74) *Attorney, Agent, or Firm* — WPAT, PC

(57) ABSTRACT

A driving circuit for a display panel and including a receiving interface, a timing controller, a pulse width modulation controller and a line latch is disclosed. The receiving interface is configured to receive a first input signal, a second input signal and a link signal to generate a plurality of display data accordingly, wherein the first input signal and the second input signal are a pair of differential signals. The timing controller is configured to interpret the first input signal, the second input signal and the link signal to generate a trigger signal. The pulse width modulation controller is configured to perform pulse width modulation to generate a first output signal and a second output signal. The line latch is configured to hold the first and second output signals, and output the first and second output signals according to the trigger signal to drive the display panel.

20 Claims, 10 Drawing Sheets

DRIVING CIRCUIT AND RELATED DRIVING METHOD

RELATED APPLICATIONS

This application claims priority to Taiwan Application Serial Number 110105534, filed Feb. 18, 2021, which is herein incorporated by reference in its entirety.

BACKGROUND

Field of Invention

The disclosure relates to a driving circuit and a related driving method. More particularly, the disclosure relates to a drive circuit for driving the display panel according to a pair of differential input signals and a related driving method.

Description of Related Art

Large-scale display panels (such as televisions, advertising billboards, etc.) are usually formed by several light boxes, and each light box is provided with a motherboard and several driving circuit boards. The motherboard is configured to transmit data; one side of the driving circuit board is provided with light-emitting elements, and the other side is provided with a driving chip and a scan switch circuit.

In practical applications, for example, a 55-inch display panel with a resolution of 768*432 square pixels may consist of four light boxes, each of which includes a motherboard and eight driving circuit boards. Each of the drive circuit boards is provided with thirty-six drive chips to drive sub-panels with a resolution of 96*108 square pixels.

In the condition of the size of the display panel being unchanged, if the resolution increases to 3840*2160 square pixels to support ultra-high-definition (UHD) display specifications, the number of the driver chips and signal lines on each driver circuit board needs to be increased by five times, that is, the number of drive chips on each drive circuit board needs to be increased to one hundred and eighty. In this case, due to the increase in the number of driver chips and signal lines per unit area, the difficulty of circuit design will greatly increase.

In addition, when the input image signal is a transistor-transistor logic (TTL) signal and is transmitted in parallel with the clock signal, the input image signal is easily affected by noise or signal distortion due to propagation attenuation.

Therefore, how to provide a display driving circuit and a related display driving method to save circuit area, simplify circuit design, and avoid signal distortion is actually one of the issues in this field.

SUMMARY

In order to solve the above-mentioned problems, the present disclosure provides a driving circuit for a display panel. The driving circuit includes a receiving interface, a timing controller, a pulse width modulation controller and a line latch is disclosed. The receiving interface is configured to receive a first input signal, a second input signal and a link signal to generate a plurality of display data accordingly, wherein the first input signal and the second input signal are a pair of differential signals. The timing controller is configured to interpret the first input signal, the second input signal and the link signal to generate a trigger signal. The pulse width modulation controller is coupled to the timing controller, and configured to perform pulse width modulation according to the trigger signal and the plurality of display data, in order to generate a first output signal and a second output signal. The line latch is couple to the pulse width modulation controller, configured to hold the first and second output signals, and output the first and second output signals according to the trigger signal to drive the display panel.

The present disclosure also provides a driving method for a display panel, comprising: receiving a first input signal, a second input signal and a link signal with a receiving interface to generate a plurality of display data, wherein the first input signal and the second input signal are a pair of differential signals; interpreting the first input signal, the second input signal and the link signal with a timing controller to generate a trigger signal; performing pulse width modulation with a pulse width modulation controller according to the trigger signal and the plurality of display data to generate a first output signal and a second output signal; holding the first output signal and the second output signal with a line latch temporarily, and outputting the first output signal and the second output signal according to the trigger signal to drive the display panel.

In the case of using the differential signal of the driving circuit and related driving methods of the present disclosure, the data transmission speed can be effectively increased, thus the driving circuit can support higher resolution and frame rate display panels. There is no need to set up a random access memory (RAM) in the drive circuit to pre-store a large amount of data, thus the area of the drive circuit can be effectively reduced. Because the differential signal has the features of strong anti-interference ability and accurate timing positioning, signal distortion can be avoided, and no additional clock signal needs to be referred to, thus the circuit design can be simplified.

BRIEF DESCRIPTION OF THE DRAWINGS

Aspects of the present disclosure are best understood from the following detailed description when read with the accompanying figures.

DETAILED DESCRIPTION

In following disclosure, when a component is called "connect" or "couple", it can refer to "electrically connect" or "electrically couple". "Connect" or "couple" can also be used to indicate the coordinated operation or interaction between two or more components. In addition, although terms such as "first", "second", etc. are used herein to describe different elements, the terms are only used to distinguish elements or operations described in the same technical terms. Unless the context clearly indicates, the terms do not specifically refer to or imply the order or sequence, nor are they used to limit the present disclosure.

Figure 1:
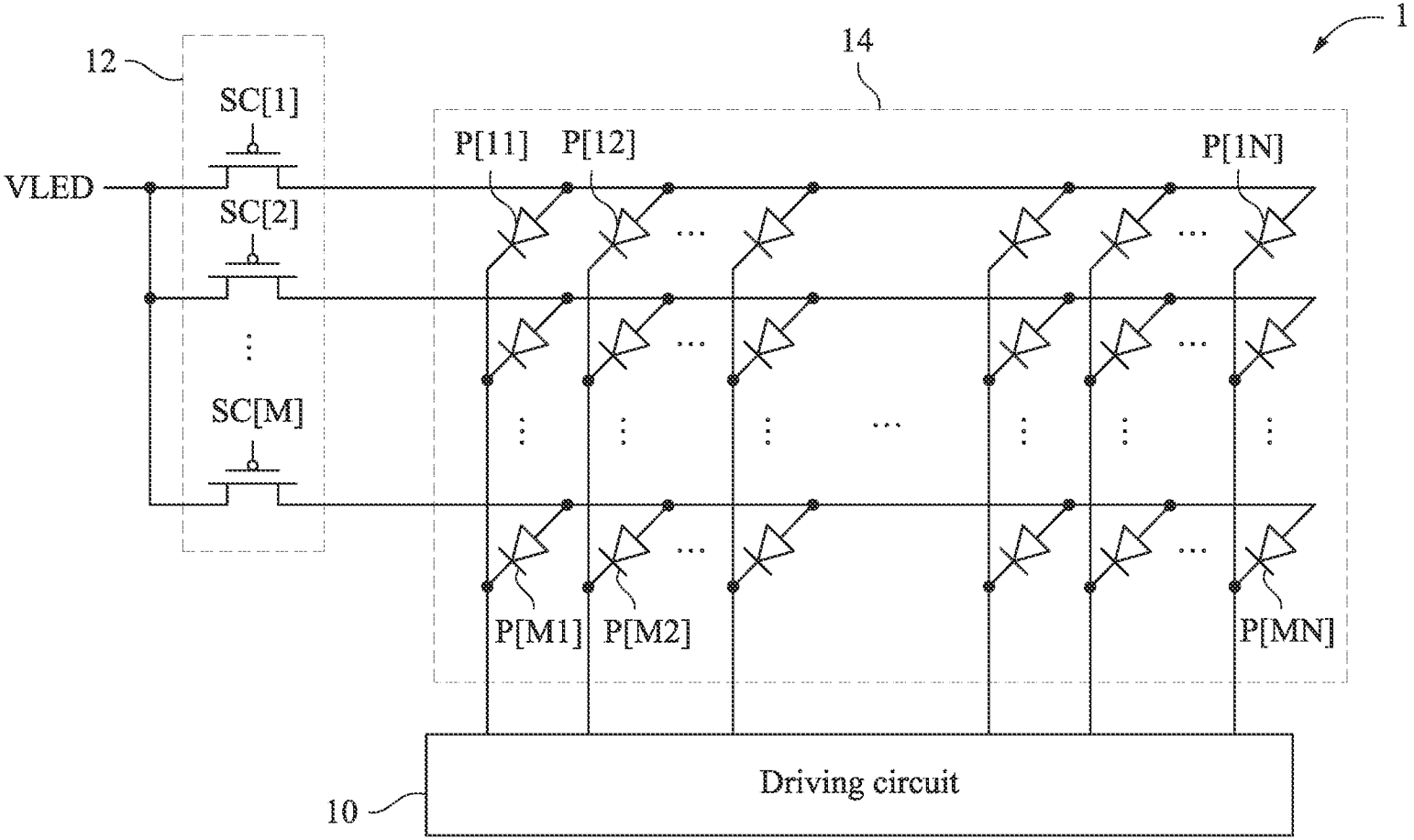
FIG. 1 is a functional block diagram of a display device, in accordance with some embodiments.

FIG. 1 is a functional block diagram of a display device 1. The display device 1 includes a driving circuit 10, a scan switch circuit 12 and a display panel 14. The display panel 14 includes M*N pixels P[11]-P[1N], P[M1]-P[MN], and M and N are integers greater than one. The display panel 14 is, for example, a common-anode passive matrix light-emitting diode (PMLED) panel. In terms of structure, each pixel is implemented by a light-emitting diode, the anodes of the N diodes in each row are electrically connected to a scan line, and the cathodes of the M diodes in each column are electrically connected to a data line or a channel. The display panel 14 is coupled to the scan switch circuit 12 through the M scan lines, and is coupled to the driving circuit 10 through the N data lines (or channels).

In operation, the scan switch circuit 12 includes M switches for providing a driving voltage VLED to the display panel 14 according to the M scan signals SC[1]-SC[M]. The driving circuit 10 is configured to provide an output signal SDO (drawn in FIG. 3) according to an input signal SDI, a control signal LE (drawn in FIG. 4) and a data clock signal DCLK (drawn in FIG. 4) to the display panel 14. In one embodiment, each switch of the scan switch circuit 12 is implemented by a P-type transistor, which includes a control terminal coupled to a scan signal, a first terminal coupled to the driving voltage VLED, and a second terminal coupled to a scan line.

Figure 2:
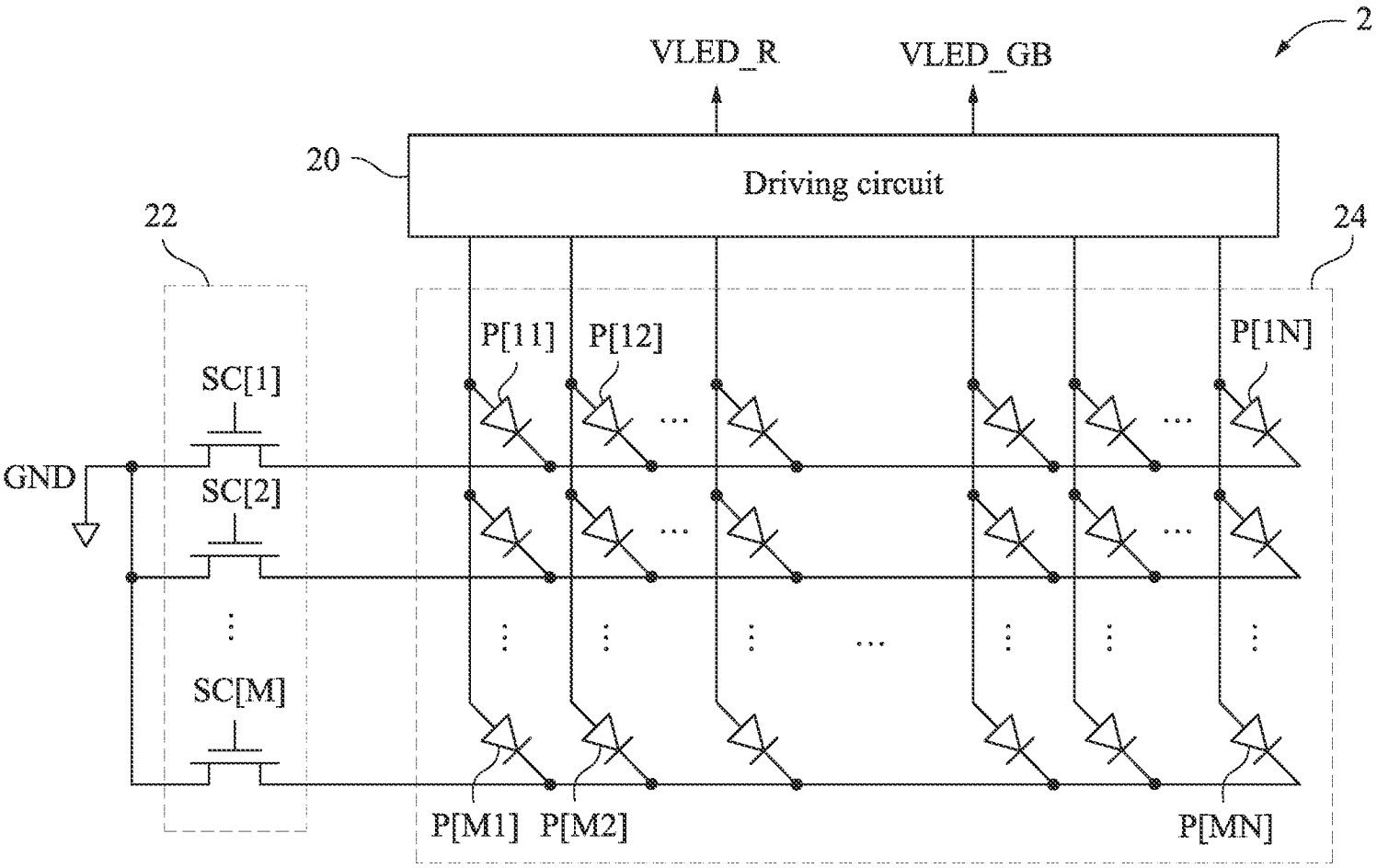
FIG. 2 is another function block diagram of a display device, in accordance with some embodiments.

FIG. 2 is another function block diagram of a display device 2. The display device 2 includes a driving circuit 20, a scan switch circuit 22 and a display panel 24. The display panel 24 is, for example, a common-cathode passive matrix light-emitting diode (PMLED) panel. In terms of structure, each pixel is implemented by a light-emitting diode, the cathodes of the N diodes in each row are electrically connected to a scan line, and the anodes of the M diodes in each column are electrically connected to a data line or a channel. The display panel 24 is coupled to the scan switch circuit 22 through the M scan lines, and is coupled to the driving circuit 20 through the N data lines.

In operation, the scan switch circuit 22 includes M switches for coupling the display panel 24 to a ground voltage GND according to the M scan signals SC[1]-SC[M]. The driving circuit 20 is configured to provide an output signal SDO (drawn in FIG. 3) according to a plurality of driving voltages VLED_R and VLED_GB, a control signal LE, a input signal SDI, and a clock signal DCLK (the signals LE, SDI, and DCLK are shown in FIG. 4) to the display panel 24. In one embodiment, each switch of the scan switch circuit 22 is implemented by a N-type transistor, which includes a control terminal coupled to a scan signal, a first terminal coupled to the ground voltage GND, and a second terminal coupled to a scan line.

Figure 3:
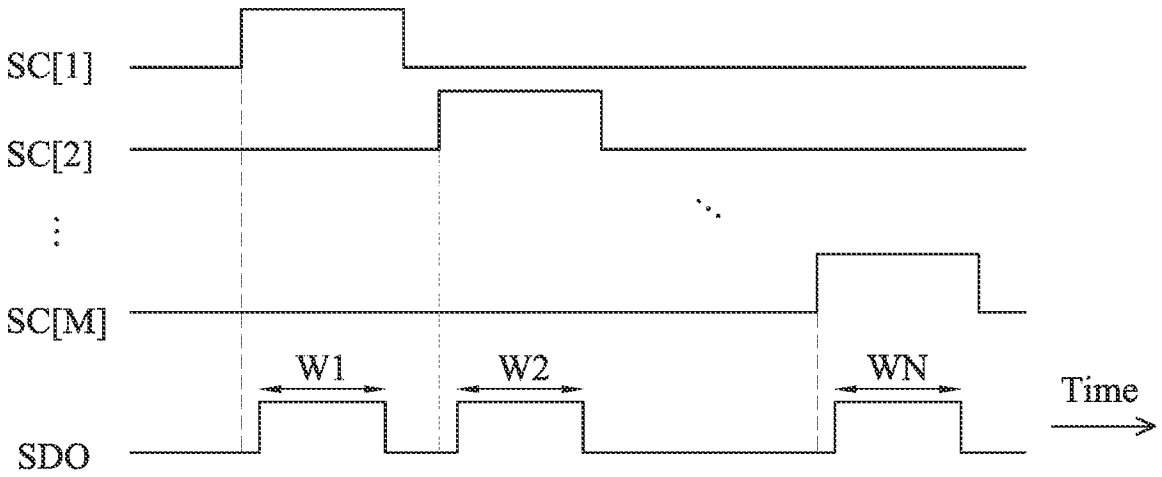
FIG. 3 is a timing diagram of multiple scan signals of the scan switch circuit and an output signal of the driving circuit of FIG. 1 and FIG. 2, in accordance with some embodiments.
Figure 4:
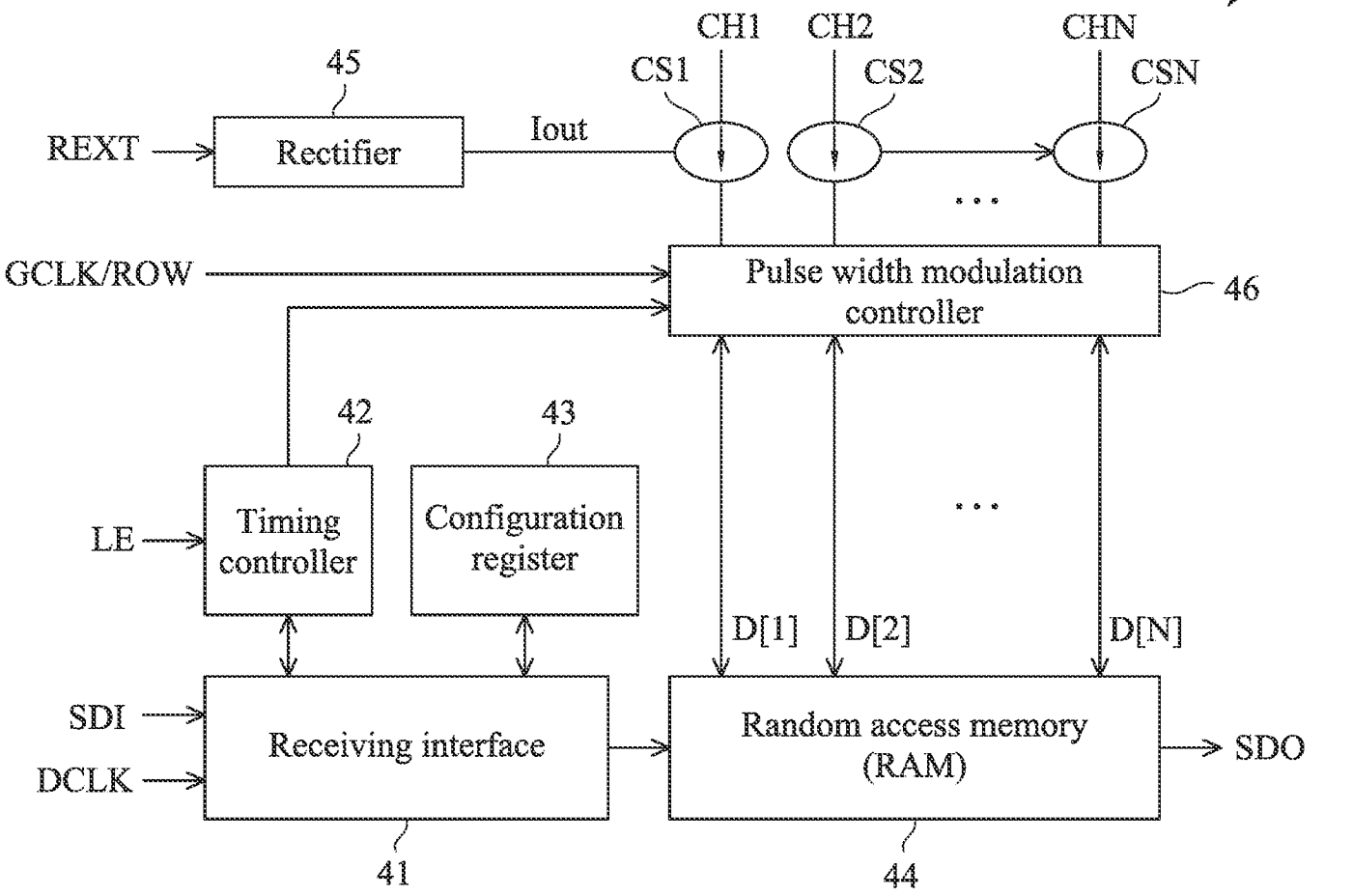
FIG. 4 is a functional block diagram of the driving circuit used in FIG. 1 and FIG. 2, in accordance with some embodiments.

FIG. 3 is a timing diagram of multiple scan signals SC[1]-SC[M] of the scan switch circuit 12, 22 and an output signal SOD of the driving circuit 10, 20 of FIG. 1 and FIG. 2. When the scan signal SC[1] is in a first logic state (for example, logic "1"), the N pixels P[11]-P[1N] coupled to the first scan line are turned on, and the brightness corresponding to the grayscale values of the pixels P[11]-P[1N] is determined by the on-time W1. The longer time the pixel is turned on, the corresponding brightness is higher (representing a higher gray scale value). And the like, when the scan signal SC[2] is in a first logic state, the N pixels P[21]-P[2N] coupled to the second scan line are turned on, and the brightness corresponding to the grayscale values of the pixels P[21]-P[2N] is determined by the on-time W2. On the other hand, when the scan signals SC[1]-SC[M] are in a second logic state (for example, logic "0"), the pixels are turned off. Simply, scan switch circuits 12 and 22 respectively conduct N pixels coupled to $1^{st}$-$M^{th}$ scan lines according to a plurality of scan signals SC[1]-SC[M], and the output signal SDO of drive circuits 10 and 20 respectively controls the brightness of the N pixels during on-times W1-WN. In this way, the scan switch circuits 12, 22 and the driving circuits 10, 20 may drive the display panels 14, 24 to display images respectively.

FIG. 4 is a functional block diagram of a driving circuit 40. The driving circuit 40 may replace the driving circuits 10 and 20 of FIG. 1 and FIG. 2. The driving circuit 40 includes a receiving interface 41, a timing controller 42, a configuration register 43, a random access memory (RAM) 44, a rectifier 45, a pulse width modulation controller 46 and a plurality of current sources CS1-CSN.

The architecture of the driving circuit 10 is shown in FIG. 4. The receiving interface 41 is configured to receive the input signal SDI and the data clock signal DCLK, and accordingly generate a plurality of display data D[1]-D[N]. The timing controller 42 is configured to receive and interpret the control signal LE. The configuration register 43 is configured to store at least one configuration parameter, such as but not limited to grayscale mode, scan mode, gain of output current, color parameters, etc. The rectifier 45 is coupled to an external resistor (not shown in FIG. 4), and a resistance value REXT of the external resistor determines an output current $I_{out}$ generated by the rectifier 45. The current sources CS1-CSN are configured to generate multiple drive currents for the multiple channels CH1-CHN according to the output current $I_{out}$. The pulse width modulation controller 46 is configured to perform pulse width modulation according to a gray-scale clock signal GCLK, a trigger signal ROW, and multiple display data D[1]-D[N] corresponding to multiple channels CH1-CHN. The RAM 44 is configured to store the display data of (2*m*N) pixels corresponding to the (2*m) row, and m is the number of scans that the driving circuit 10 can support. For example, assuming that driving circuit 10 scans one row of pixels at a time (meaning m=1), the RAM 44 stores the display data of (2*1*N) pixels corresponding to two rows at a time. When the driving circuit 10 is driving the N pixels of the $Y^{th}$ scan line, the RAM 44 stores the display data $D_Y$[1]-$D_Y$[N] of the N pixels corresponding to the $Y^{th}$ scan line, and store the display data $D_{Y+1}$[1]-$D_{Y+1}$[N] corresponding to the N pixels of the $(Y+1)^{th}$ scan line, and Y is an integer greater than zero. Then, when the driving circuit 10 is driving a plurality of pixels corresponding to the $(Y+1)^{th}$ scan line, in the RAM 44, the display data $D_Y[1]$-$D_Y[N]$ of the N pixels corresponding to the $Y^{th}$ scan line are copied as the display data $D_{Y+2}[1]$-$D_{Y+2}[N]$ corresponding to the N pixels of the (Y+2) scan line. In other words, when the driving circuit 10 is driving the N pixels of the $Y^{th}$ scan line, the output signal SDO generated by the RAM 44 contains the display data $D_Y[1]$-$D_Y[N]$ corresponding to the N pixels of the $Y^{th}$ scan line; therefore, when the driving circuit 10 is driving the N pixels of the $(Y+1)^{th}$ scan line, the output signal SDO generated by the RAM 44 contains the display data $D_{Y+1}[1]$-$D_{Y+1}[N]$ corresponding to the N pixels of the $(Y+1)^{th}$ scan line. In this way, the output signal SDO generated by the driving circuit 10 includes the N display data D[1]-D[N] corresponding to different scan lines, which are configured to drive the N pixels connected to different scan lines respectively.

Figure 5:
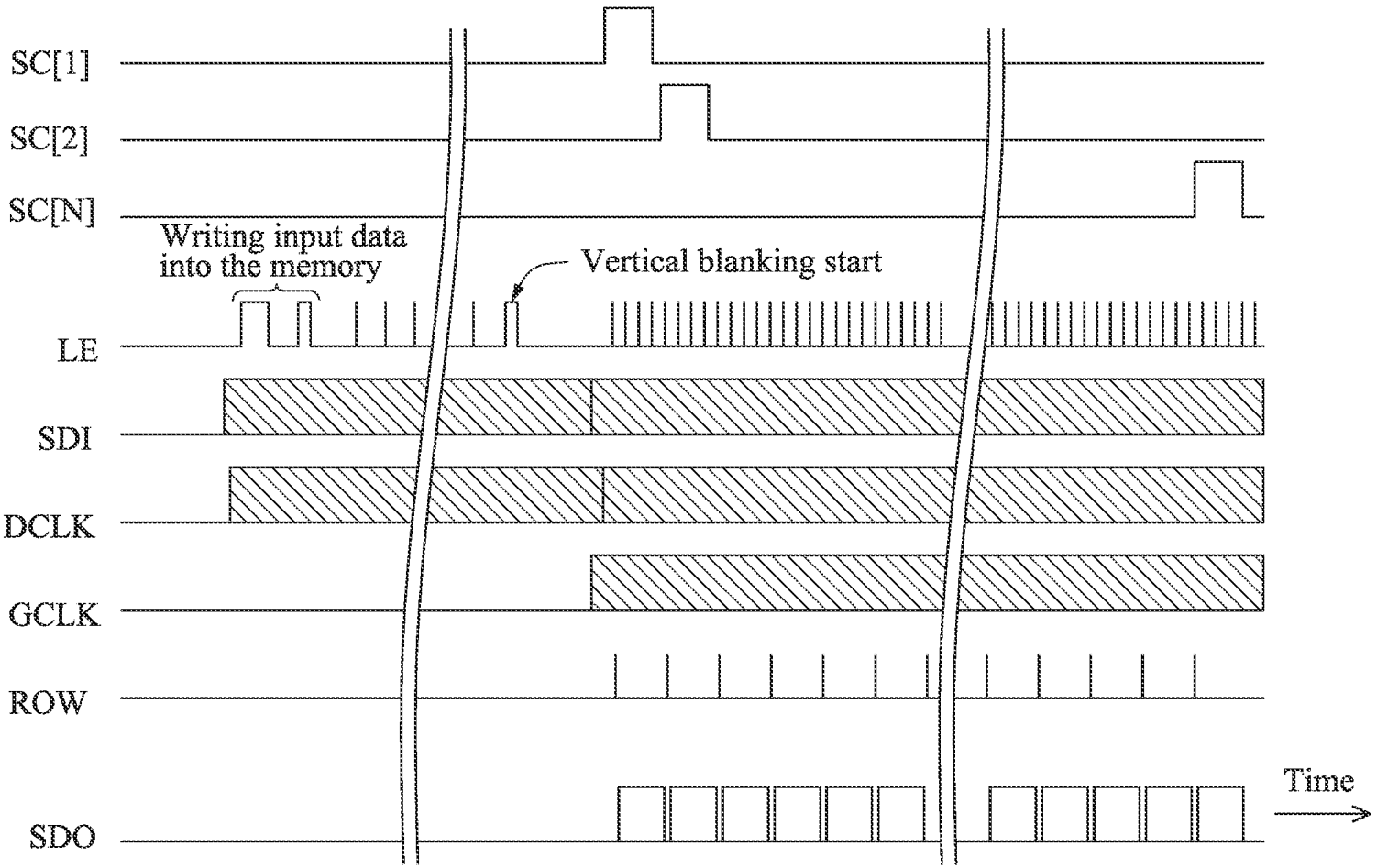
FIG. 5 is a timing diagram of multiple scan signals and the control signals, the input signals, the data clock signals, the gray-scale clock signals, the trigger signals, and the output signals used in the drive circuit of FIG. 4, in accordance with some embodiments.

FIG. 5 is a timing diagram of multiple scan signals SC[1]-SC[M] and the control signals LE, the input signals SDI, the data clock signals DCLK, the gray-scale clock signals GCLK, the trigger signals ROW, and the output signals SDO used in the drive circuit 10 of FIG. 4. The control signal LE and the clock signal DCLK are configured to instruct the drive circuit 10 to perform operations, such as writing input data into the memory, setting display parameters, vertical blanking start, and displaying data. The gray-scale clock signal GCLK or the driving signal ROW is configured to instruct the driving circuit 10 to control the output timing of the output signal SDO. For example, the rising edge of the trigger signal ROW is configured to indicate the turn-on time of one scan line, and the rising edge of the gray-scale clock signal GCLK is configured to indicate the turn-on time of multiple data lines (or channels).

It is noted that, the driving circuit 40 in FIG. 4 has the following characteristics: (1) The RAM 44 occupies a considerable proportion of the circuit area (according to the support scan, the RAM 44 occupies about 30%-40% circuit area); (2) The input signal SDI and the data clock signal DCLK are both transistor-transistor logic (TTL) signals, thus they are only suitable for low-speed transmission; and (3) The driver chip has a large number of input pins (for example, at least six pins are required to connect the resistance value REXT, the gray-scale clock signal GCLK, the trigger signal ROW, the control signal LE, the input signal SDI and the data clock signal DCLK). In order to solve the above-mentioned problems, a driving circuit and related driving method is disclosed, which saves the circuit area, simplifies circuit design and avoids signal distortion.

Figure 6:
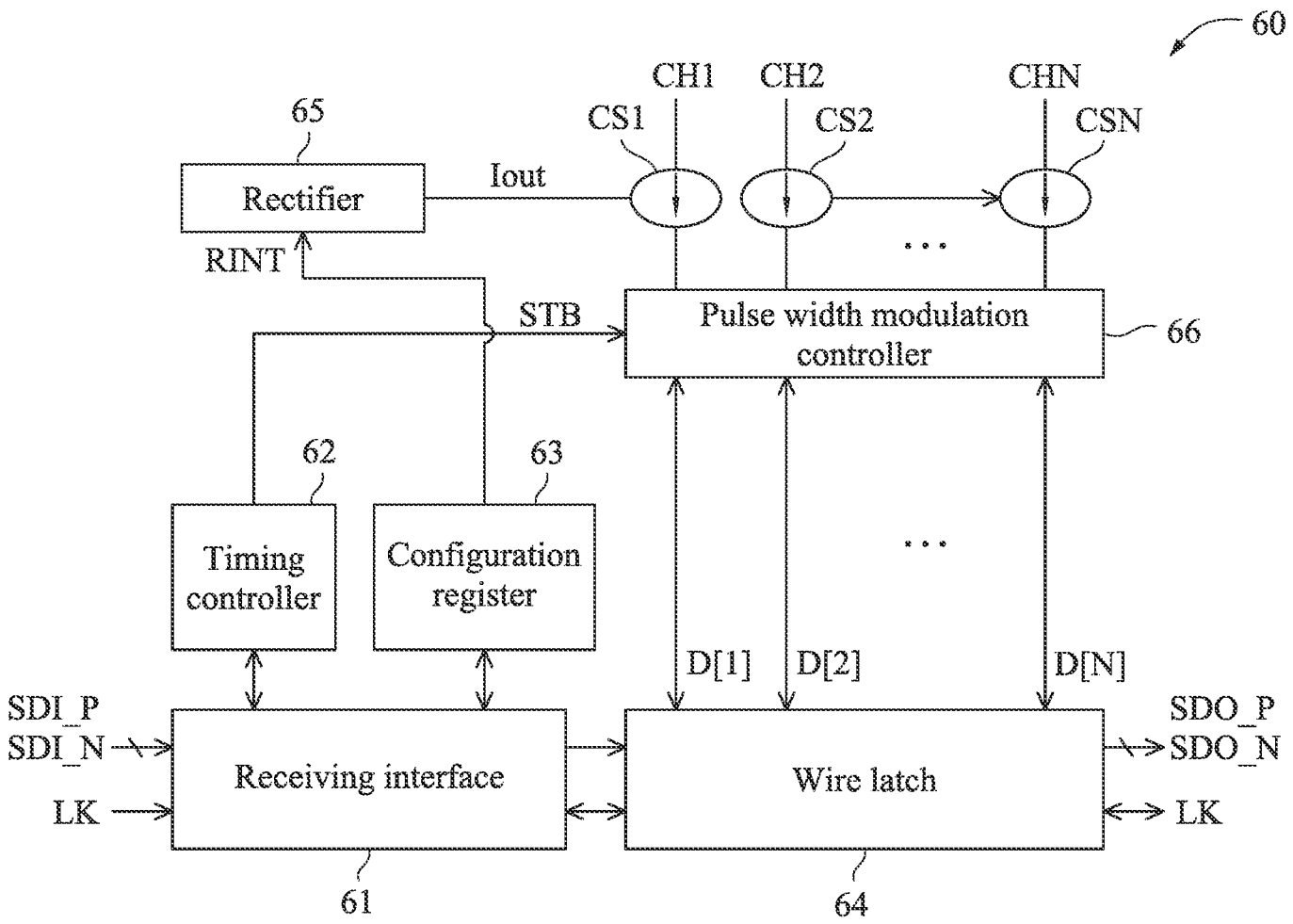
FIG. 6 is a functional block diagram of a driving circuit, in accordance with the embodiment of the disclosure.

FIG. 6 is a functional block diagram of a driving circuit 60, in accordance with the embodiment of the disclosure. The driving circuit 60 may replace the driving circuits 40 of FIG. 4. The driving circuit 60 includes a receiving interface 61, a timing controller 62, a configuration register 63, a wire latch 64, a rectifier 65, a pulse width modulation controller 66 and a plurality of current sources CS1-CSN.

The receiving interface 61 is coupled to the timing controller 62, the configuration register 63 and the line latch 64 for receiving a first input signal SDI_P, a second input signal SDI_N and a link signal LK, according to which multiple display data D[1]-D[N] are generated. The link signal LK is a signal for communication between the driving circuit 60 and an input signal source (such as a processor), and the link signal LK may be a bidirectional or unidirectional control signal. The timing controller 62 is coupled to the receiving interface 61 and the pulse width modulation controller 66 for receiving the first input signal SDI_P, the second input signal SDI_N, and the link signal LK with the receiving interface 61, and the interprets first input signal SDI_P, the second input signal SDI_N and the link signal LK, to generate a trigger signal STB to the pulse width modulation controller 66. The configuration register 63 is coupled to the receiving interface 61 for storing at least one configuration parameter, such as but not limited to an output current parameter RINT, gray scale mode, scanning mode, and color parameters, etc. The rectifier 65 is coupled to the configuration register 63 and multiple current sources CS1-CSN, and is configured to generate an output current $I_{out}$ to the current sources CS1-CSN according to an output current parameter RINT. The current sources CS1-CSN are coupled to the rectifier 65 and the pulse width modulation controller 66, and are configured to generate multiple driving currents to the pulse width modulation controller 66 for the multiple channels CH1-CHN according to the output current $I_{out}$. The pulse width modulation controller 66 is coupled to the timing controller 62 and the line latch 64, and is configured to perform pulse width modulation according to the trigger signal STB and multiple display data D[1]-D[N] corresponding to the channels CH1-CHN, to generate a first output signal SDO_P and a second output signal SDO_N. The line latch 64 is coupled to the receiving interface 61 and the pulse width modulation controller 66 to temporarily hold the first output signal SDO_P and the second output signal SDO_N, and output the first output signal SDO_P and the second output signal SDO_N according to the trigger signal STB.

It is noted that, in the disclosed embodiment, the first input signal SDI_P and the second input signal SDI_N are a differential pair of signal configured to replace the single-wired input signal SDI in FIG. 4. The data rate supported by the single-line signal is megabit per second, and the data rate supported by the differential signal is gigabit per second. In the case of using a differential signal, the data transmission speed may be effectively increased, thus the driving circuit 60 can support a higher resolution and frame rate display panel. There is no need to provide the RAM 44 in the driving circuit 60 to pre-store a large amount of data, thus the area of the driving circuit 60 (relative to the driving circuit 40) may be effectively reduced. In practical applications, compared to the driving circuit 40, when the original supported scans is 16, the die size of the driving circuit 60 can be reduced by 8%-15%; when the original supported scans is 32, the die size of the driving circuit 60 can be reduced by 16%-30%; and when the original supported scans is 64, the die size of the driving circuit 60 can be reduced by 30%-60%. In one embodiment, the scan switch circuit 12 of FIG. 1 or the scan switch circuit 22 of FIG. 2 may be integrated with the driving circuit 60 on the same integrated circuit chip.

Further, since the differential signal has the features of strong anti-interference ability and accurate timing positioning, signal distortion can be avoided, and no additional clock signal (such as the data clock signal DCLK) needs to be referred to. The timing controller 62 can reconstruct (or generate) related timing signals (such as the trigger signal STB) according to the first input signal SDI_P and the second input signal SDI_N, thus the driving circuit 60 does not need to receive additional gray-scale clock signals GCLK and trigger signal ROW. In addition, under the premise that the application range of the display panel is known, the resistor configured to control the output current $I_{out}$ (resistance value REXT) can be integrated in the drive circuit 60, and the output current $I_{out}$ can be set with the output current parameter RINT. In this way, it may be seen from FIG. 6 that the number of input pins of the driving circuit 60 may be simplified to three (for example, at least three pins are required to connect the first input signal SDI_P, the second input signal SDI_N, and the link signal LK).

Figure 7:
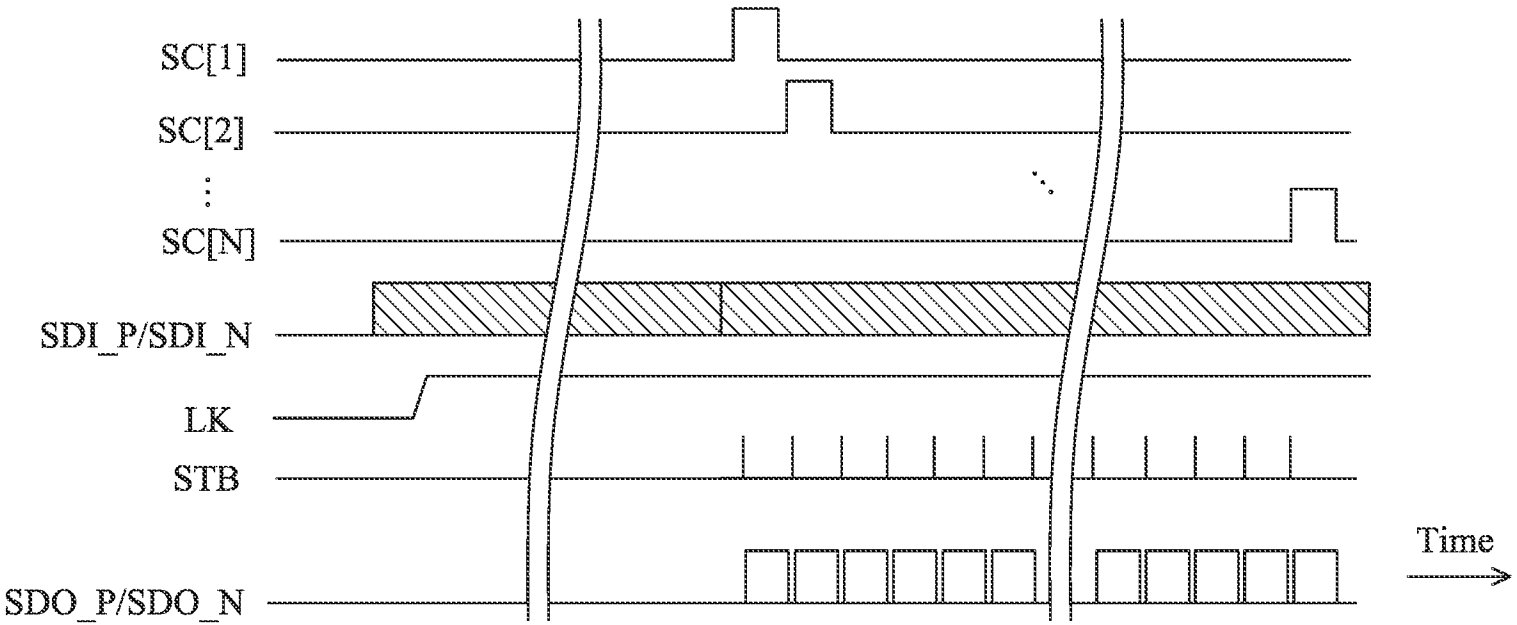
FIG. 7 is a timing diagram of multiple scan signals and the first input signal, second input signal, the link signal, the trigger signal, the first output signal, and the second output signal used in the driving circuit of FIG. 6, in accordance with the embodiment of the disclosure.

FIG. 7 is a timing diagram of multiple scan signals SC[1]-SC[N] and the first input signal SDI_P, the second input signal SDI_N, the link signal LK, the trigger signal STB, the first output signal SDO_P, and the second output signal SDO_N used in the driving circuit 60 of FIG. 6, in accordance with the embodiment of the disclosure. The first input signal SDI_P and the second input signal SDI_N are configured to instruct the drive circuit 60 to perform operations, such as setting display parameters, vertical blanking start, displaying data and reconstructing the trigger signal STB. On the rising edge of the scan signals SC[1]-SC[N], the driving circuit 60 synchronously generates the rising edge of the trigger signal STB (configured to indicate the opening time of the data line or channel) and outputs the first output signal SDO_P and the second output Signal SDO_N to display data.

Figure 8:
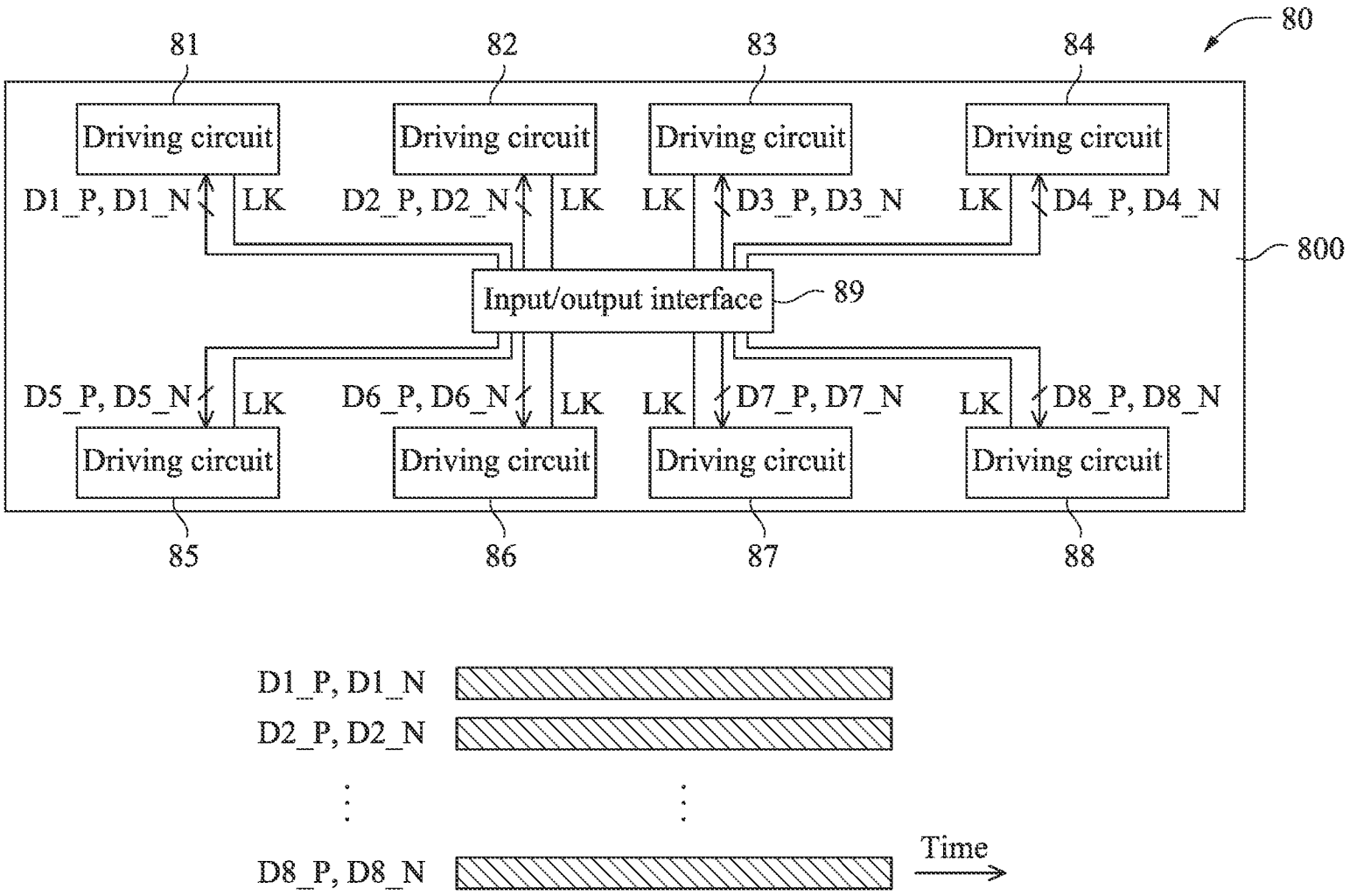
FIG. 8 is a schematic diagram of a driving module and multiple pairs of input signals, in accordance with the embodiment of the disclosure.

FIG. 8 is a schematic diagram of a driving module 80, multiple first input signals D1_P-D8_P and multiple second input signals D1_N-D8_N, in accordance with the embodiment of the disclosure. In terms of structure, the driving module 80 includes a circuit board 800, a plurality of driving circuits 81-88, and an input/output interface 89. The driving circuits 81-88 and the input/output interface 89 are located on the circuit board 800, and the input/output interface 89 is connected in parallel with the driving circuits 81-88 to transmit the link signal LK, the first input signals D1_P-D8_P, and the second input signals D1_N-D8_N to the driving circuits 81-88 in parallel. In one embodiment, the input/output interface 89 may be provided on another circuit board different from the circuit board 800.

In operation, the input/output interface 89 may simultaneously receive the first input signals D1_P-D8_P, the second input signals D1_N-D8_N and the link signal LK from a signal input source, transmit the link signal LK to the driving circuits 81-88 for communication, and simultaneously transmit the first input signals D1_P-D8_P and the second input signals D1_N-D8_N to the driving circuits 81-88 in parallel. In this way, the present disclosure may realize parallel transmission, and the data rate per unit time may be multiples (for example, eight times) of the data rate of single point transmission.

Figure 9:
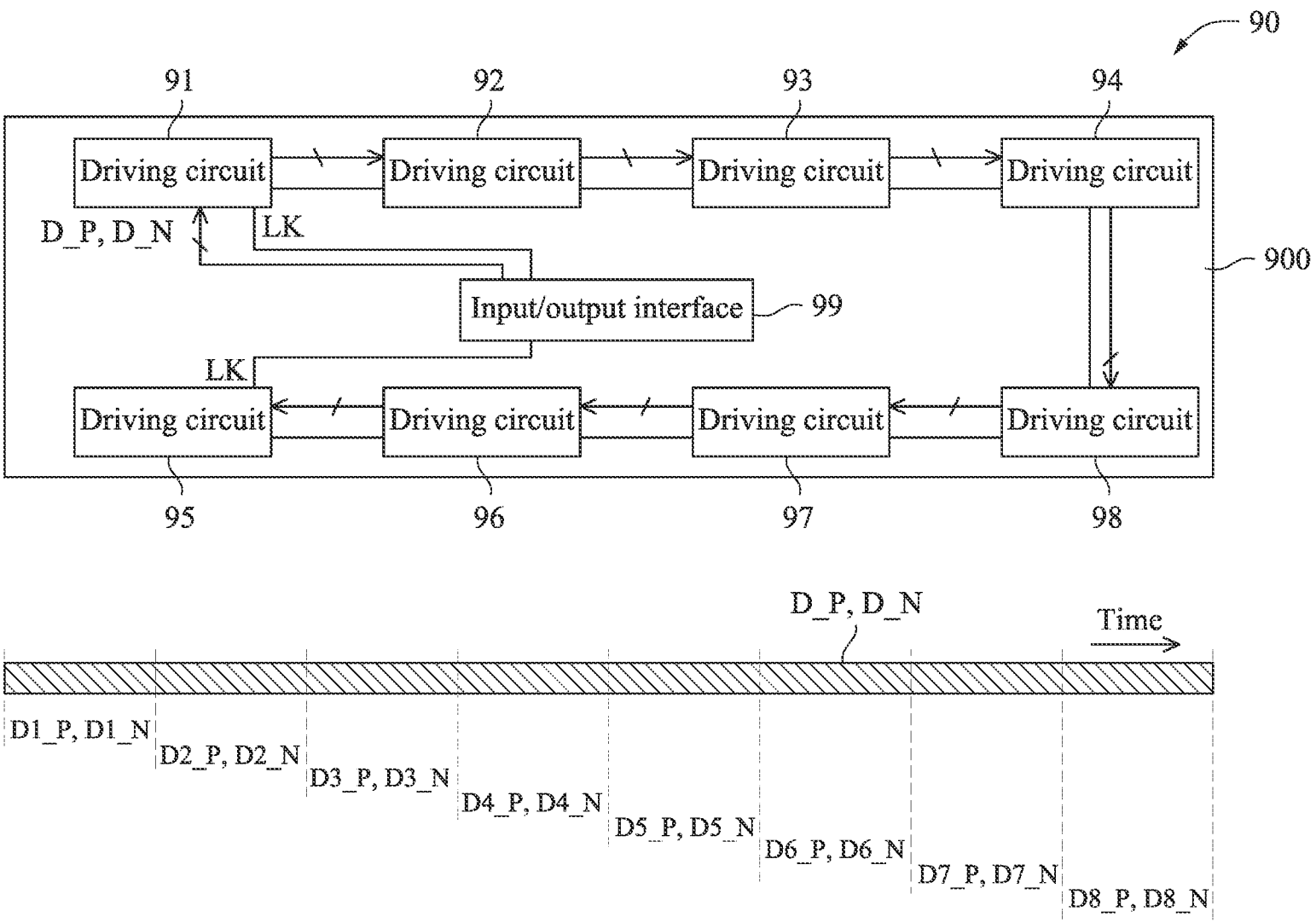
FIG. 9 is a schematic diagram of another driving module and multiple pairs of input signals, in accordance with the embodiment of the disclosure.

FIG. 9 is a schematic diagram of another driving module 90, a first input signal D_P and a second input signal D_N, in accordance with the embodiment of the disclosure. The first input signal D_P includes a plurality of first input signals D1_P-D8_P, and the second input signal D_N includes a plurality of second input signals D1_N-D8_N. In terms of structure, the driving module 90 includes a circuit board 900, a plurality of driving circuits 91-98, and an input/output interface 99. The driving circuits 91-98 and the input/output interface 99 are located on the circuit board 900, and the input/output interface 99 is connected with the driving circuits 91-98 in series with each other. The input/output interface 99 transmits the link signal LK, the first input signals D1_P-D8_P, and the second input signals D1_N-D8_N to the driving circuits 91-98 sequentially.

In operation, the input/output interface 99 may receive the link signal LK, the first input signal D_P, and the second input signal D_N from a signal input source. The input/output interface 99 communicates with the driving circuits 91-98 with the link signal LK. For example, the upstream signal source informs the downstream receiving end to receive display data with the link signal LK, thus the driving circuits 91-98 sequentially receive the first input signal D1_P-D8_P and the second input signal D1_N-D8_N. In this way, the present disclosure may realize cascade transmission, and the signal transmission path in the driving module 90 is the shortest, which simplifies the circuit design and avoids signal distortion. Those skilled in the art can select the number of serially connected drive circuits according to actual applications to achieve the optimization of data rate and circuit board layout.

In the embodiments shown in FIG. 8 and FIG. 9, parallel transmission and serial transmission can be mixed and used. In other words, some driving circuits connected in parallel with the input/output interfaces and some driving circuits connected in series with the input/output interfaces can be set on a single circuit board to achieve the optimization of the data rate and the layout of the circuit board.

Figure 10:
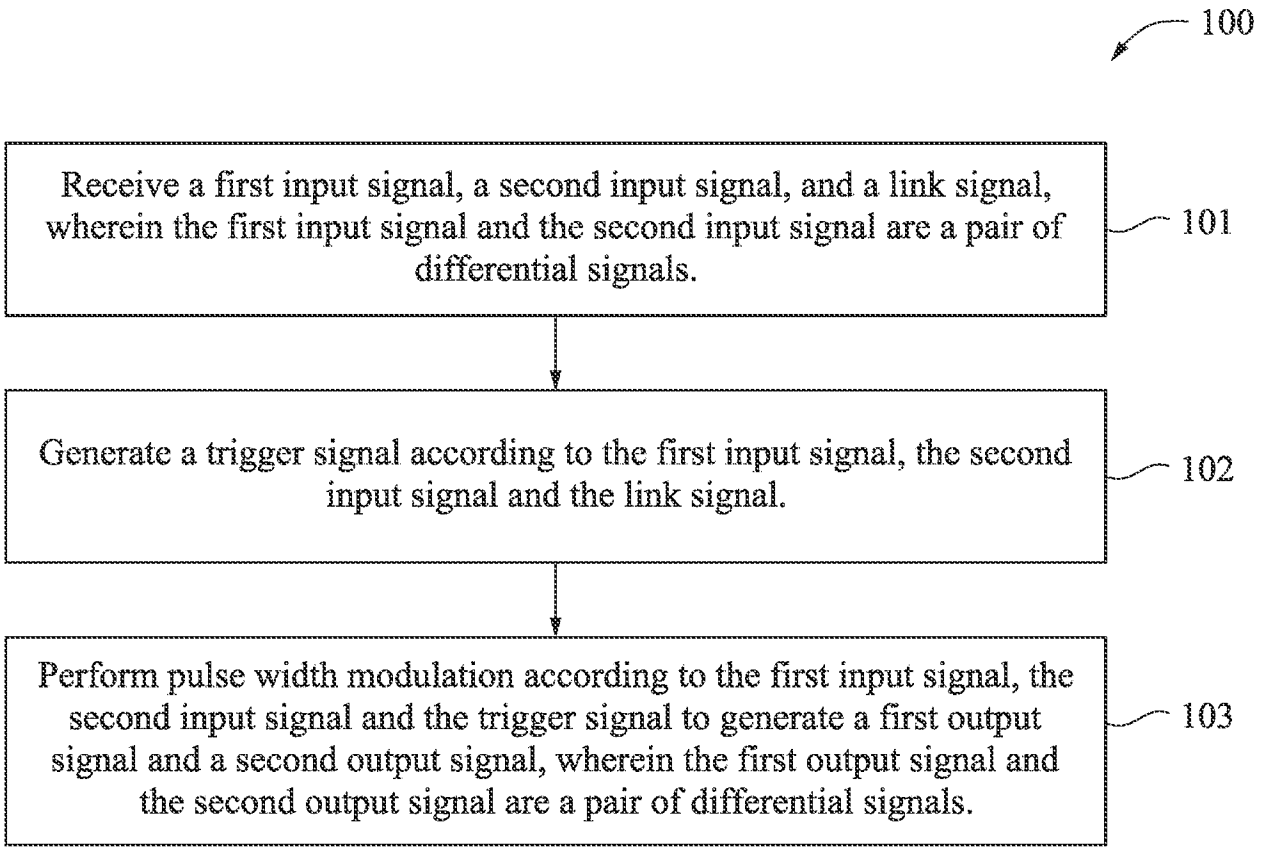
FIG. 10 is a flowchart of a driving process, in accordance with the embodiment of the disclosure.

FIG. 10 is a flowchart of a driving process 100, in accordance with the embodiment of the disclosure. The operation modes of the driving circuits 60, 81-88 and 91-98 can be summarized as a driving process 100 for driving the display panel. The driving process 100 includes the following steps.

Step 101: Receive a first input signal, a second input signal, and a link signal, wherein the first input signal and the second input signal are a pair of differential signals.

Step 102: Generate a trigger signal according to the first input signal, the second input signal and the link signal.

Step 103: Perform pulse width modulation according to the first input signal, the second input signal and the trigger signal to generate a first output signal and a second output signal, wherein the first output signal and the second output signal are a pair of differential signals.

Step 104: Hold the first output signal and the second output signal with the line latch temporarily, and output the first output signal and the second output signal according to the trigger signal.

In the driving process 100, step 101 may be performed by the receiving interface 61, step 102 may be performed by the timing controller 62, step 103 may be performed by the pulse width modulation controller 66, and step 104 may be performed by the line latch 64. In one embodiment, the driving process 100 further includes generating an output current parameter to a rectifier with a configuration register. Through the driving process 100, the present disclosure may drive the display panel without using random access memory (RAM), which can save circuit area, simplify circuit design, and avoid signal distortion.

In summary, in the case of using the differential signal of the driving circuit and related driving methods of the present disclosure, the data transmission speed can be effectively increased, thus the driving circuit can support higher resolution and frame rate display panels. There is no need to set up a random access memory (RAM) in the drive circuit to pre-store a large amount of data, thus the area of the drive circuit can be effectively reduced. Because the differential signal has the features of strong anti-interference ability and accurate timing positioning, signal distortion can be avoided, and no additional clock signal needs to be referred to, thus the circuit design can be simplified.

Also, although the disclosure has been shown and described with respect to one or more implementations, equivalent alterations and modifications will occur to others of ordinary skill in the art based upon a reading and understanding of this specification and the annexed drawings. The disclosure comprises all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A driving circuit for a display panel, comprising:

a receiving interface configured to receive a first input signal, a second input signal and a link signal to generate a plurality of display data, wherein the first input signal and the second input signal are a pair of differential signals;

a timing controller configured to receive the first input signal, the second input signal, and the link signal through the receiving interface, and interpret the first input signal, the second input signal, and the link signal to generate a trigger signal;

a pulse width modulation controller coupled to the timing controller to perform pulse width modulation according to the trigger signal and the plurality of display data to generate a first output signal and a second output signal; and a line latch coupled to the pulse width modulation controller to hold the first output signal and the second output signal temporarily, and output the first output signal and the second output signal to drive the display panel according to the trigger signal.

2. The driving circuit of claim 1, comprising:

a configuration register coupled to the receiving interface to store an output current parameter;

a rectifier coupled to the configuration register to generate an output current according to the output current parameter; and a plurality of current sources coupled to the rectifier and the pulse width modulation controller to generate a plurality of driving currents to the pulse width modulation controller according to the output current.

3. The driving circuit of claim 2, wherein the output current parameter is gray scale mode, scanning mode, or color parameters.

4. The driving circuit of claim 2, further comprising a resistor configured to control the output current.

5. The driving circuit of claim 1, wherein the link signal is a bidirectional control signal or a unidirectional control signal.

6. The driving circuit of claim 1, wherein the driving circuit is utilized in a driving module, and the driving module comprises:

an input/output interface configured to receive a plurality of first input signals, a plurality of second input signals and the link signal from a signal input source simultaneously; and a plurality of drive circuits connected in parallel with the input/output interface;

wherein the input/output interface transmits the link signal, the plurality of first input signals, and the plurality of second input signals to the plurality of driving circuits in parallel.

7. The driving circuit of claim 6, wherein the driving module comprises a circuit board, and the input/output interface and the plurality of driving circuits are located on the circuit board, or the plurality of driving circuits are located on the circuit board and the input/output interface is located on another circuit board.

8. The driving circuit of claim 1, wherein the driving circuit is utilized in a driving module, and the driving module comprises:

an input/output interface configured to receive the first input signal, the second input signal, and the link signal from a signal input source, wherein the first input signal includes a plurality of first input signals, and the second input signal includes a plurality of second input signals; and a plurality of driving circuits connected to the input/output interface in series;

wherein the input/output interface sequentially transmits the link signal, the plurality of first input signals, and the plurality of second input signals to the plurality of driving circuits.

9. The driving circuit of claim 8, wherein the driving module comprises a circuit board, and the input/output interface and the plurality of driving circuits are located on the circuit board, or the plurality of driving circuits are located on the circuit board and the input/output interface is located on another circuit board.

10. The driving circuit of claim 8, wherein the display panel is a common anode passive matrix light-emitting diode panel, the scan switch circuit includes a plurality of P-type transistor switch.

11. The driving circuit of claim 8, wherein the display panel is a common cathode passive matrix light-emitting diode panel, the scan switch circuit includes a plurality of N-type transistor switches.

12. The driving circuit of claim 1, wherein the driving circuit is utilized in a driving module, and the driving module comprises a scan switch circuit, the scan switch circuit and the driving circuit are integrated on a same integrated circuit chip.

13. A driving method, utilized for driving a display device, comprising:

receiving a first input signal, a second input signal and a link signal with a receiving interface to generate a plurality of display data, wherein the first input signal and the second input signal are a pair of differential signals;

interpreting the first input signal, the second input signal and the link signal with a timing controller to generate a trigger signal;

performing pulse width modulation with a pulse width modulation controller according to the trigger signal and the plurality of display data to generate a first output signal and a second output signal; and holding the first output signal and the second output signal with a line latch temporarily, and outputting the first output signal and the second output signal according to the trigger signal to drive the display panel.

14. The driving method of claim 13, further comprising:

storing an output current parameter with a configuration register;

generating an output current with a rectifier according to the output current parameter; and generating a plurality of driving current with a plurality of current sources to the pulse width modulation controller according to the output current.

15. The driving method of claim 14, wherein the output current parameter is gray scale mode, scanning mode, or color parameters.

16. The driving method of claim 14, further comprising controlling the output current with a resistor.

17. The driving method of claim 13, further comprising displaying an image according to the first output signal and the second output signal.

18. The driving method of claim 13, wherein the link signal is a bidirectional control signal or a unidirectional control signal.

19. The driving method of claim 13, further comprising:

receiving a plurality of first input signals, a plurality of second input signals and the link signal from a signal input source simultaneously with an input/output interface; and transmitting the link signal, the plurality of first input signals and the plurality of second input signals to a plurality of driving circuits in parallel with the input/output interface, wherein the plurality of driving circuits are connected in parallel with the input/output interface.

20. The driving method of claim 13, further comprising:

receiving the first input signal, the second input signal and the link signal from a signal input source with an input/output interface, wherein the first input signal includes a plurality of first input signals, and the second input signal includes a plurality of second input signals; and transmitting the link signal, the plurality of first input signals and the plurality of second input signals to a plurality of driving circuits, wherein the plurality of driving circuits and the input/output interface are connected in series with each other.

* * * * *